US005154279A

United States Patent [19]

Hänsch

[11] Patent Number: 5,154,279

[45] Date of Patent: Oct. 13, 1992

[54] THICKNESS MEASUREMENT OF PRINTED PRODUCTS IN A SCALE FLOW

[75] Inventor: Egon Hänsch, Wetzikon, Switzerland

[73] Assignee: Ferag AG, Hinwil, Switzerland

[21] Appl. No.: 754,021

[22] Filed: Sep. 3, 1991

[30] Foreign Application Priority Data

Oct. 5, 1990 [CH] Switzerland ..... 03231/90

[51] Int. Cl.[5] ..... B65G 43/00

[52] U.S. Cl. ..... 198/502.2; 271/263

[58] Field of Search ..... 198/502.2, 460, 462, 198/470.1; 271/263, 262; 33/501.02

[56] References Cited

U.S. PATENT DOCUMENTS

| | | | |
|---|---|---|---|
| 2,312,357 | 3/1943 | Odquist et al. | 198/502.2 |
| 4,560,159 | 12/1985 | Staub | 271/263 |
| 5,022,644 | 6/1991 | Burge | 198/460 |

FOREIGN PATENT DOCUMENTS

| | | |
|---|---|---|
| 458733A2 | 4/1991 | European Pat. Off. . |
| 870422 | 3/1953 | Fed. Rep. of Germany . |
| 3419436 | 12/1984 | Fed. Rep. of Germany . |
| 3823201 | 12/1988 | Fed. Rep. of Germany . |
| 3913740 | 11/1989 | Fed. Rep. of Germany . |
| 1094863 | 12/1967 | United Kingdom . |

*Primary Examiner*—Joseph E. Valenza
*Attorney, Agent, or Firm*—Walter C. Farley

[57] ABSTRACT

In a scale flow, particularly in a dense scale flow (S4) of flat articles such as printed products, the thickness of each individual element between a deflectable measurement part and a reference part is measured. The reference part in a timed movement for each measurement engages below that part of the scale which forms the surface of the scale flow. The reference part is constructed as an impeller (22), which is positioned laterally of the scale flow (S4) in such a way that its vanes 22.1–22.4, if the impeller (22) is rotated about its spindle (23), are moved between the scale located on the surface and the remainder of the scale flow. The deflectable measurement part is constructed as a sensing roll (21), which is pressed into an adjustable neutral position by spring tension. The deflection of the sensing roll (21) is measured and interrogated in timing manner. The timed cycle of the movement of the reference part and the timing cycle of the interrogation of the measured value are synchronized and are matched to the speed of the scale flow and the reciprocal spacing of the scale flow elements.

19 Claims, 3 Drawing Sheets

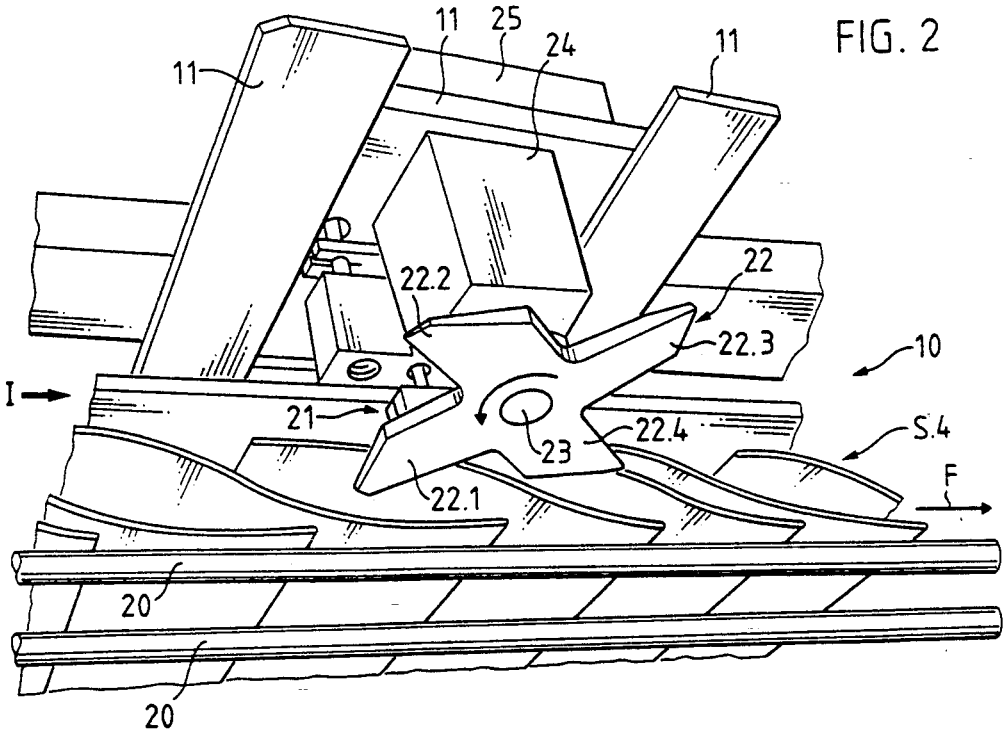
FIG. 2
FIG. 3
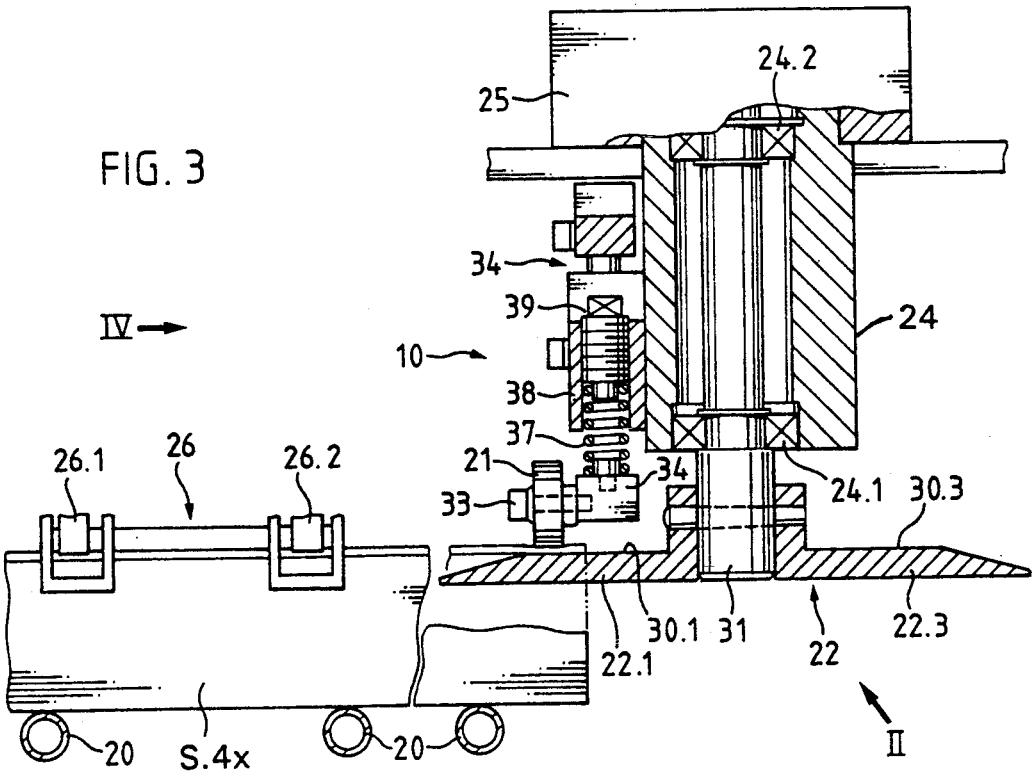

THICKNESS MEASUREMENT OF PRINTED PRODUCTS IN A SCALE FLOW

FIELD OF THE INVENTION

The invention relates to the thickness measurement of flat objects, e.g. printed products, particularly when such articles are moved in a scale flow and relates to a method and an apparatus for performing the method.

BACKGROUND OF THE INVENTION

Thickness measurement is an appropriately usable checking measurement with respect to printed products or articles. It is advantageously carried out at the start or finish of processing stages or on conveying means. It can e.g. be established whether at a specific point of the processing sequence the correct number (e.g. 1) of successive printed products is being conveyed or whether individually conveyed printed products have the correct number of pages, i.e. whether they are complete and possibly also whether they contain folded or otherwise damaged pages. It is important to detect as rapidly as possible irregularities in the continuous feed flow or delivery and remove as early as possible from the processing sequence incomplete or damaged copies. When processing at high speeds, irregularities in the feed or conveying flow not only lead to faulty products, but also, if introduced into processing stages, can cause production interruptions or even damage to machinery. Further processing of damaged or incomplete copies reduces the production capacity, increases the amount of waste and the probability of delivering inadequate products. It is also possible to systematically check and control the participating machinery through checks on products between the individual processing stages.

Apparatuses for measuring the thickness of printed products are e.g. known from U.S. Pat. No. 4,560,159 assigned to Applicant's assignee and the corresponding Swiss patent 660 350 and as well as DE-OS 39 13 740 and DE-OS 38 23 201. The printed products are passed in a thickness measurement station between a reference part, e.g. a fixed roll or roller, and a deflectable measurement part, e.g. a deflectable rotary roll or roller, the reference part being fitted on one side of the conveyed flow and the measurement part on the other side. In the inoperative position the two parts have a spacing from one another which is smaller than the thickness of the flow. The deflection of the measurement part is measured and interrogated in a time cycle corresponding to that of the printed products conveyed through the measurement station. Such prior art apparatuses are suitable for checking the regularity of the conveying flow and/or for checking the individual copies, i.e. it can detect a double copy in a flow of individual copies, or also a copy having a thickness not corresponding to the desired thickness. The measured result can be easily evaluated if it is a flow of successive, individual copies or a scale flow with a large scale spacing. In the case of a scale flow with a large scale spacing the individual copies are so far apart that only the edges of each copy rest on the preceding or following copy, whilst the central part of each copy is free, i.e. the scale spacing A (distance between an edge of a copy and the corresponding edge of the following copy) is greater than half the length L of a copy in the conveying direction, i.e. $A > L/2$. Thus, for each copy there is a point at which the scale flow thickness corresponds to the copy thickness. However, it is only in such a scale flow with a large scale spacing that the prior art apparatuses are able to directly measure the thickness of each individual printed product in the scale flow.

However, if printed products are conveyed in a scale flow with a small scale spacing, i.e. in a scale flow in which the scale spacing A is equal to or smaller than half the copy length L ($A \leqq L/2$), so that at each point of the scale flow several printed products rest on one another, although the described apparatuses which measure the thickness of the entire flow can still establish errors in the organization of the scale flow and errors on copies, they are unable to establish which of the measured copies is faulty, because in all cases several copies are measured together. The faulty copy can only be established with considerable calculation expenditure. In particular when using the prior art measuring apparatuses, special evaluation methods are required for the start and finish of such a scale flow, because at these points it has thicknesses which are not "normal".

It would be desirable to have a method and/or an apparatus enabling the thickness of flat articles, e.g. printed products, which are moved in a flow, particularly in a scale flow with small scale spacings ($A \leqq L/2$) to be measured and, specifically, the thickness of individual elements or the thickness of each individual element of the scale flow. For thickness measurement purposes it should not be necessary to reorganize and stop the scale flow. The evaluation of the measured results should always be the same for a continuous scale flow, particularly for its starting and finishing portions. The results of the thickness measurement must be usable for controlling means for ejecting damaged or incomplete copies and parts of the scale flow containing organizational errors. Apart from the checking of scale flows with a small scale spacing, the method and apparatus must also be usable for checking scale flows with a large scale spacing and individually conveyed printed products. The method and apparatus must be usable at a maximum number of different feed or conveying flow locations.

BRIEF DESCRIPTION OF THE DRAWINGS

The method and an embodiment of an apparatus are described in greater detail hereinafter relative to the attached drawings, wherein:

FIG. 2 is a perspective view of the preferred embodiment of the inventive apparatus showing the underside of the scale flow;

FIG. 3 is a transverse sectional view of the apparatus according to FIG. 2 along a line III—III of FIG. 4 which is at right angles to the conveying direction.

DESCRIPTION OF THE PREFERRED EMBODIMENTS

According to the method of the invention, measurement takes place in a specific manner of the thickness of flat articles, e.g. printed products, which are conveyed in a scale flow, preferably on that part of the individual scale flow elements, projecting over the surface of the scale flow. This is achieved by a time-synchronized interaction of the measuring arrangement with the moving scale flow.

The actual thickness measurement takes place between a measurement part and a reference part, the measurement part being displaceable in the measurement direction from a neutral position, but is always driven back into the neutral position by a corresponding force, whilst at least during the measurement the reference part is positioned in such a way (measurement position), that the distance between the neutral position of the measurement part and the reference part is the same for all measurements. The deflection or displacement of the measurement part is measured. The thickness of the measured element of the scale flow is obtained from this displacement, plus the spacing between the reference part in the measurement position and the measurement part in the neutral position. This spacing is advantageously adjustable either through the adjustability of the neutral position of the measurement part or the measurement position of the reference part and is set smaller than a minimum thickness of the element to be measured. The reference or measurement part can fulfil the function of the interaction part and this is preferably performed by the reference part.

Figure 1A:
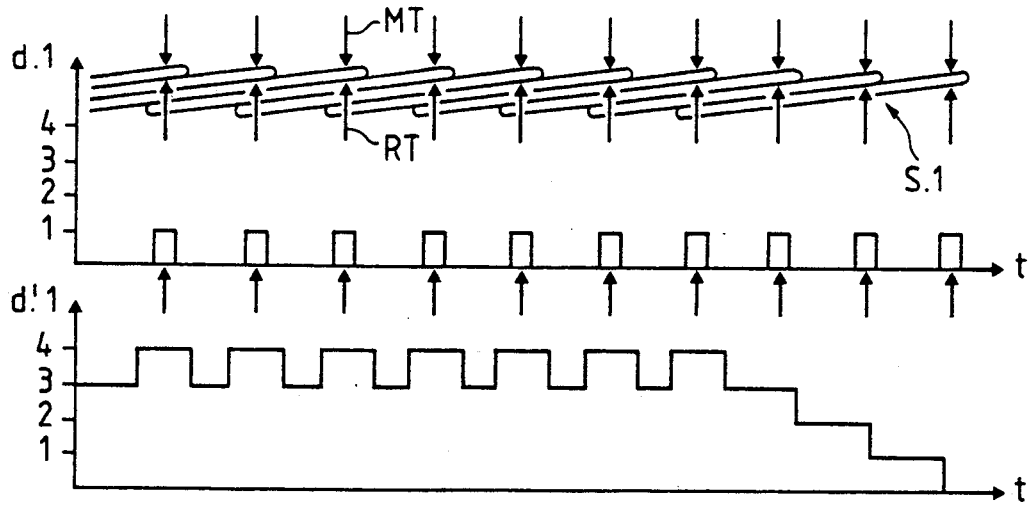
FIGS. 1*a* to 1*c* are graphs or diagrams for explaining the inventive method compared with a prior art method for a scale flow with a small scale spacing (FIG. 1*a*), for a scale flow with a large scale spacing (FIG. 1*b*) and for a flow of individual elements (FIG. 1*c*)
Figure 1B:
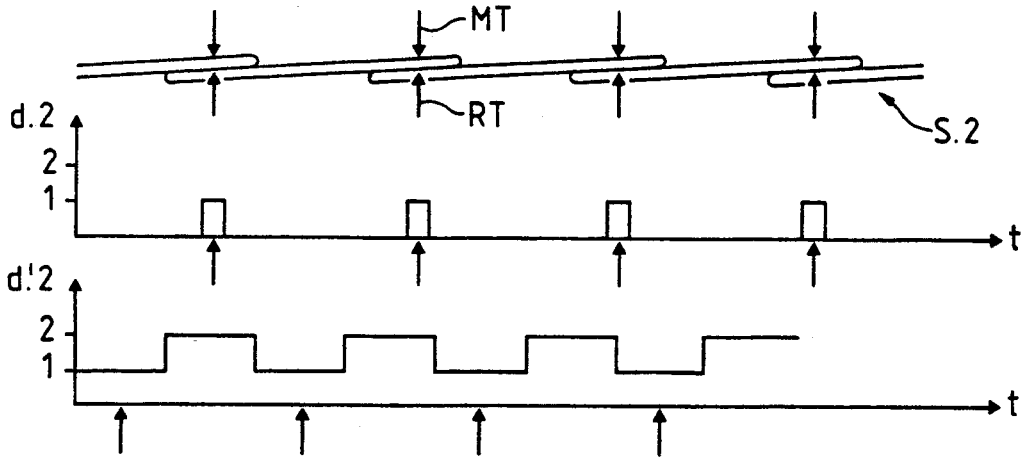
Figure 1C:
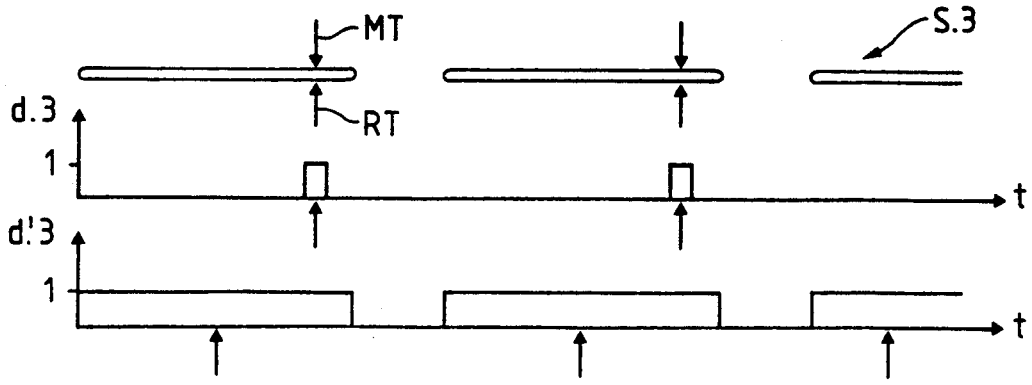

FIGS. 1*a*, 1*b* and 1*c* diagrammatically show the inventive method on a scale flow S1 with a small scale spacing ($A<L/2$) (FIG. 1*a*), on a scale flow S2 with a large scale spacing ($A>L/2$) (FIG. 1*b*) and on a feed or conveying flow S3 in which the elements are individual conveyed (FIG. 1*c*). The representations show the delivery flow over a time axis, in which the thickness measurement point is moved relative to the said flow. Directly below each flow S1, S2 or S3 and related to the same time axis t is shown the continuous measurement signal d of the measuring arrangement, specifically, d.'1, d.'2, and d.'3, respectively, as the measurement signal from the inventive method and d.'1; d.'2, or d.'3, respectively, as the measurement signal from a prior art measuring method. The intensity of the measurement signal is plotted on the ordinate of the corresponding graph as a number of measured elements.

FIG. 1*a* shows a scale flow S1 with a small scale spacing, in which in each case three or four elements rest on one another. A prior art thickness measurement with e.g. one measurement part over and one reference part under the scale flow gives a measurement signal which always corresponds to three of four elements and at the start or finish of the flow rises or falls in step-like manner (d'1). Even if the measuring arrangement is so sensitive, that it can detect faults such as a faulty page in one of the conveyed printed products, it is still not possible to establish in which of the superimposed elements of the scale flow the page is missing. The arrows indicated in the scale flow mark the position of the measurement part MT and reference part RT for each measurement with the inventive method. The measurement part is located for the measurements above the scale flow and the reference part, which is simultaneously the interaction part, for each measurement engages in the scale flow. Between the measurements, the measurement part remains in its position and the reference part moves out of the scale flow, so that for the next measurement it can engage in the latter again in order to reach the necessary measurement position. The measurement positions successively taken up by the reference part are in absolute terms locally the same, but are modified positions relative to the elements of the scale flow. If the reference part is not in the measurement position, the measurement part is in its neutral position. The interaction of the reference part with the scale flow, apart from its engagement in the latter, comprises slightly raising at least partly from the scale flow each element thereof for measurement purposes and moving the same against the measurement part.

The measured value is interrogated in timed manner (arrows under the graph d/t), in such a way that the interrogation timing cycle corresponds to that of the reference part movement and is interrogated when the reference part is in the measurement position. The right-hand part of the diagram clearly shows that the same signal occurs at the start and finish of the scale flow as in the central part thereof. If a measured signal does not correspond to the desired value, then the measured scale flow element is e.g. double, damaged or incomplete and is clearly identified by the time of the measured signal. As a function of the synchronization of the cycle with the scale flow, each individual element or individual elements are measured in a regular sequence.

FIG. 1*b* shows the same graph or diagram as FIG. 1*a*, but for a scale flow S2 with a large scale spacing and FIG. 1*c* for the conveying flow of individual elements S3. It is apparent from the two graphs and specifically from a comparison of the two signal sequences d2, d'2 and d3, d'3, that the inventive method (signals d2, d3) is also usable, but leads to no special advantages compared with the method according to the prior art (signals d'2, d'3). The arrows under the measurement signals d'2 and d'3 give the times at which the measurement signals must be interrogated so that only one element is measured.

The inventive thickness measurement method consequently substantially comprises that the spacing produced by a scale flow element between a part of the measuring arrangement located outside the scale flow and part of the measuring arrangement (interaction part) interacting with the scale flow is measured. Preferably the measurement part outside the scale flow is quasi-stationary, whereas the reference part (as the interaction part) is movable in such a way that at least portions thereof move between positions inside and outside the scale flow. Arrangements with a stationary reference part and a moving measurement part (as the interaction part) are also conceivable. In the preferred method variant the reference part engages laterally in the scale flow and namely between the scale flow element located on the surface and the remainder of the scale flow, as shown in FIGS. 1*a* and 1*b*. According to a variant the movable part of the measuring arrangement engages from the top surface of the scale flow beneath the individual elements instead of from the side. Such a method is in particular usable for scale flows of folded printed products on the surface where the folds are located.

As one part of the measurement arrangement engages between the scale flow elements, it is not possible to prevent a certain friction between these elements and that part of the measurement arrangement. This friction leads to a force on the scale flow elements, which attempts to move them out of their correct location within the scale flow. It is therefore advantageous to carry out the thickness measurement at locations where the individual scales, possibly for other reasons, are secured in place by corresponding means, such as e.g. clips, or to install such means at the corresponding point on the conveying section specifically for the thickness measurement. For scale flows which are conveyed with a timed conveying method and having automatic regeneration of the scale arrangement in the conveying direction, as a support against the frictional force it is merely necessary to position guides laterally of the scale flow. A corresponding, timed conveying method is e.g. described in the present Applicant's Swiss patent application 1697/90 which corresponds to EP 458,733 and U.S. Ser. No. 669,462. At the most in those cases where there are heavy, large-surface scale flow elements, which slide with difficulty on one another, the interaction part of the measurement arrangement could possibly engage without a support under the element to be measured without same moving out of its precise position in the scale flow.

If the inventive thickness measurement method is used for a flow of individually conveyed elements, then the interaction part of the measurement arrangement engages between each individual element and the flow substrate instead of between two flow elements.

For the preferred embodiment the measurement is performed on a scale flow whose elements are individually conveyed e.g. by clips over a substrate. The clips engage on that part of the element located on the surface of the scale flow and slightly raise the same from its position in the scale flow. The proposed measurement part comprises a freely rotatable roll (feeler or sensing roll), which is resiliently upwardly displaceable out of a neutral position and which is directly located above the edge of the scale flow element raised from the scale flow by the clips. The proposed reference part, which also fulfils the function of the interaction part, is positioned laterally of the scale flow and has at least one reference surface which, for measurement purposes, is moved between the top scale flow element to be measured and the remainder of the scale flow, so that during a very short time a part of each element is passed between the reference surface in the measurement position and the sensing roll. During this time the signal of the displacement of the sensing roll is interrogated. Between two measurements the reference surface is moved out of its measurement position, so that it can be moved below the next element (above the already measured element). The timed movement of the reference surface and the timed interrogation of the deflection or displacement of the sensing roll are matched to one another and to the density of the scale flow (scale spacing) and to its speed, so that each scale flow element is measured at the same point.

The reference surface of the reference part advantageously moves at a constant speed on a closed path, which is substantially located in the plane of the scale flow and during each passage passes through the measurement position between the scale flow elements. The design of the reference surface and its movement must be so matched to one another that the time in which part of the reference surface is in the measurement position at least corresponds to the time necessary for a measurement. It is also possible to use several reference surfaces, which move on a substantially identical closed path and successively reach the measurement position, so that with the aid of one of the reference surfaces, e.g. only every fourth measurement is performed.

It would also be conceivable to have a reciprocating movement of the reference surface which is stationary for the effective measurement and is accelerated and decelerated twice between the measurements.

The apparatus used for performing the inventive method essentially has a reference part, a deflectable or displaceable measurement part with a neutral position and with force means driving it into the neutral position, a sensor measuring the displacement of the measurement part and an evaluation unit interrogating in timed manner the sensor measurement signal and comparing it with a desired value and passing on a signal resulting from the comparison. The measurement part or reference part is movable in such a way that it can take over the interaction with the scale flow, i.e. for the measurement it can move between the elements of the scale flow or between the elements of the scale flow and the substrate, while the other part is positioned in stationary manner directly outside the scale flow. It is advantageous if either the measurement position of the reference part or the neutral position of the measurement part is adjustable. The sensor and the evaluation unit are commercially available standard components and are not described in greater detail hereinafter.

Figure 4:
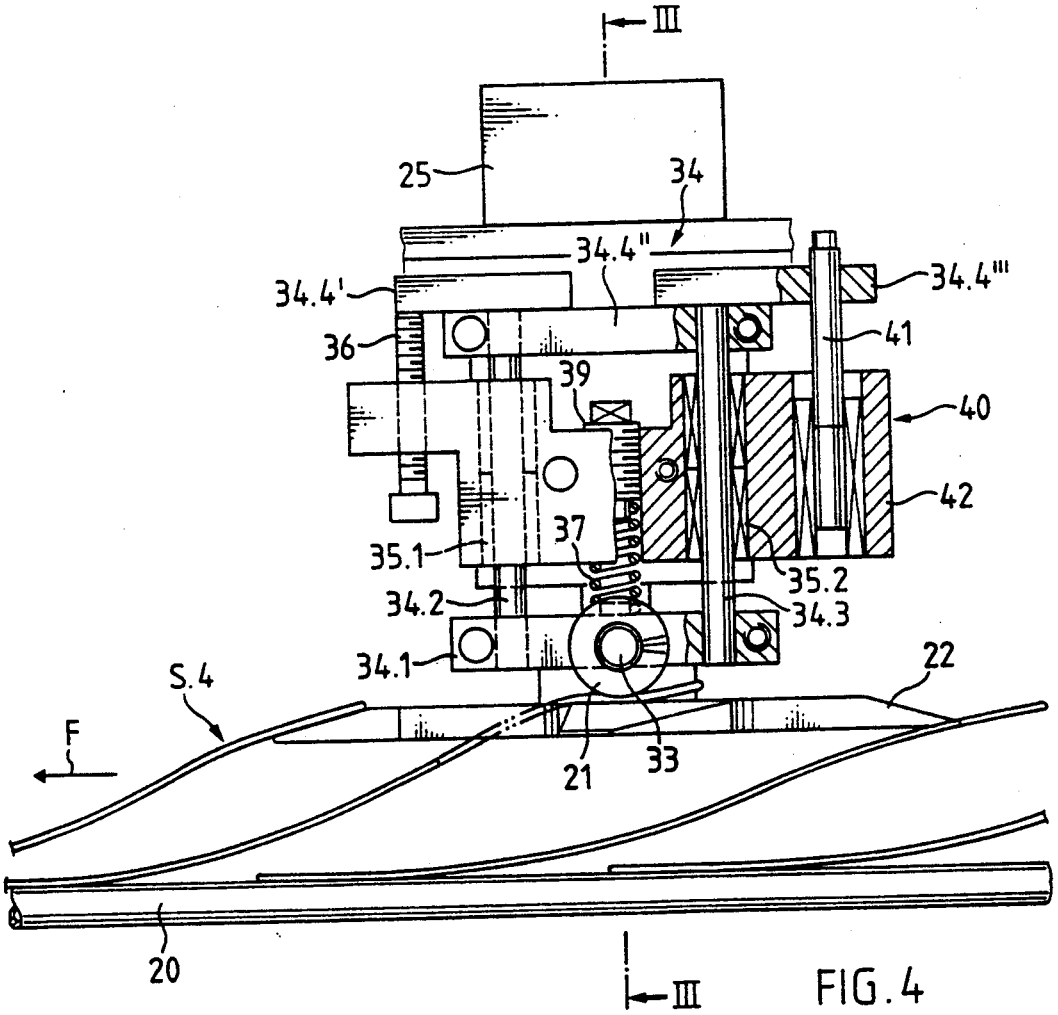
FIG. 4 is a side elevation of the apparatus according to FIG. 2.

FIGS. 2, 3 and 4 show an embodiment of the apparatus for performing the inventive method.

FIG. 2 shows the inventive apparatus 10 from below, i.e. a view toward that part of the scale flow S4 remote from the measurement part (observation direction according to arrow II of FIG. 3), which is fixed to the stationary supports 11 located above the scale flow. The scale flow S4 has a small scale spacing whose total thickness at each point corresponds to the thickness of two or three elements. The scale flow is conveyed by guide means 20 in the conveying direction (arrow F) to conveying clips (not visible), which act on each scale flow element and each element can easily be raised from the guide means 20. Above the scale flow is positioned a measurement part in the form of a displaceable or deflectable sensing roll 21 (described in detail in conjunction with FIG. 3). Laterally of the scale flow S4 is provided a reference part in the form of an impeller 22. The latter has in the present example four vanes 22.1, 22.2, 22.3, and 22.4 and is rotated in the arrow direction about an axis 23 which lies in a plane perpendicular to the direction of the thickness measurement and parallel to the conveying direction. The positions of the rotation axis or spindle 23 and the impeller 22 relative to the scale flow S4 and the radial extension of the vanes 22.1–22.4 are so matched to one another that the four reference surfaces, which are located on the vane surface remote from the viewer, on rotating the impeller 22 engage sufficiently far into the scale flow to enable thickness measurements to be carried out between the sensing roll 21 and the reference surfaces on the vanes 22.1–22.4. The speed of the impeller 22 is so matched, i.e. synchronized with the speed and density of the scale flow S4, that each flow element is detected by a vane and raised against the measurement part.

In order that this movement can take place uniformly and without damaging the scale flow element to be measured, it is advantageous to construct the vanes 22.1–22.4 in such a way that the surface facing the measurement part is bevelled in the rotation direction against the reference surface, which leads to a gentle raising of the scale flow element to be measured. The impeller 22 is driven by a drive 25 by means of a shaft which is mounted in a fixed bearing block 24. The conveying direction can also be opposite to the arrow F. The impeller can also have a different number of vanes.

FIG. 3 shows the apparatus according to FIG. 2 at right angles to the conveying direction and considered in the direction of arrow III in FIG. 2. Only one scale S4x of the scale flow S4 is visible. It is conveyed by a conveying clip 26 with the gripping elements 26.1 and 26.2. The impeller 22 is shown in sectional form, so that the reference surfaces 30.1 and 30.3 on two vanes 22.1 and 22.3 are visible. The impeller 22 is positioned in such a way that all the reference surfaces 30.2–30.4 are precisely parallel to the plane containing the upper surfaces of tubular guide means 20. The reference surface 30.1 is in the measurement position facing the sensing roll 21. A driving shaft 31 drives the impeller 22 and is e.g. mounted in two bearings 24.1 and 24.2. The drive 25 of the driving shaft 21 can e.g. be a chain drive.

The sensing roll 21 is fixed to a guide 34 so as to freely rotate on a shaft 33. The guide 34 is mounted in at least one fixed bearing (35.1, 35.2 in FIG. 4) in such a way that it can move in the direction of the conveying flow thickness (at right angles to the conveying direction). This movement is limited against the scale flow by an adjustable stop 36 shown in FIG. 4 which can be adjusted by a setscrew. This stop sets the neutral position of the sensing roll 21, which is pressed into its neutral position by a spring 37. The spring 37 is pretensioned between a fixed support 38 and the guide 34, the pretension being adjustable by a setscrew 39.

FIG. 4 shows the apparatus according to FIGS. 2 and 3 parallel to the conveying direction and considered in the direction of the arrow IV in FIG. 3. FIG. 4 shows that the guide 34 to which the sensing roll 21 is fixed by means of the spindle 33, has a lower transverse part 34.1, two guide parts 34.2 and 34.3 and an upper transverse part 34.4. The upper transverse part 34.4 is in this embodiment formed from three individual parts 34.4', 34.4'' and 34.4'''. The upper transverse part 34.4 rests on the stop 36 as soon as the sensing roll 21 is in the neutral position. The upper transverse part 34.4 carries a measuring plunger 41 of a linear, inductive displacement transducer 40, whose casing 42 with measuring coils is installed in fixed manner. The displacement transducer 40 is constituted by a commercially available transducer, which has a sensitivity e.g. corresponding to the thickness of a printed page.

The measurement output of the displacement transducer is connected to an evaluation circuit (not visible in the drawings), which interrogates the measured value in the necessary timed cycle with the aid of an adjustable timer. The measured value is compared with a desired value dependent on the desired thickness of the scales and the set neutral position of the sensing roll and in the case of a divergence a signal is transferred to corresponding control units.

FIGS. 2, 3 and 4 show how the presently discussed thickness measuring apparatus is located on a scale flow, in such a way as to enable the interaction to take place between the scale flow elements and the parts of the measuring arrangement.

I claim:

1. A method for measuring the thickness between two major surfaces of individual ones of a plurality of flat articles, particularly printed products, being conveyed in a feed flow comprising the steps of conveying the articles through a measuring location equipped with a deflectable measurement element and a reference element, synchronously with conveyance of the feed flow, moving one of the elements laterally into the feed flow, bringing the one element into contact with one major surface of one article, moving the one article to bring its other major surface into contact with the other element which is positioned above the feed flow, and determining the distance between the two elements as a measure of thickness of the article.

2. A method according to claim 1 and including measuring the thickness of each individual element in the feed flow.

3. A method according to claim 1 wherein the element moved laterally is the reference element and the other element is the measurement element and including, in the step of moving one of the elements laterally into the feed flow, inserting the reference element between overlapped articles in the feed flow.

4. A method according to claim 1 wherein the element moved laterally is the reference element and the other element is the measurement element and including, in the step of moving one of the elements laterally into the feed flow, inserting the reference element between an article in the feed flow and a conveying substrate.

5. A method according to claim 1 wherein the step of moving one of the elements includes lifting a part of the article being measured generally perpendicular to the direction of feed flow for measurement purposes.

6. A method according to claim 1 wherein one of the elements is connected to a transducer having a changing value as a function of thickness and wherein the step of determining the distance includes interrogating the transducer in synchronism with the contacting the major surfaces with the elements in accordance with a timing cycle matched to the speed of feed flow.

7. A method according to claim 6 wherein one of the elements is a reference element having a reference surface and the step of moving one of the elements includes moving the reference surface along a closed path in substantially one plane parallel to the direction of feed flow at a substantially constant speed.

8. A method according to claim 6 wherein one of the elements is a reference element having a plurality of reference surfaces and each reference surface is movable along a closed path about an axis in substantially one plane parallel to the direction of feed flow at a substantially constant speed, each reference surface passing through a measurement position during one complete revolution about the axis.

9. A method according to claim 1 wherein the reference element has a reference surface and the step of moving the reference element includes moving the reference surface along a closed path in substantially one plane parallel to the direction of feed flow at a substantially constant speed.

10. A method according to claim 1 wherein one of the elements is the reference element having a plurality of reference surfaces and each reference surface is movable along a closed path about an axis in substantially one plane parallel to the direction of feed flow at a substantially constant speed, each reference surface passing through a measurement position during one complete revolution about the axis.

11. A method according to claim 10 wherein said measurement element has an adjustable neutral position.

12. A method according to claim 11 wherein said reference element has an adjustable measurement position.

13. An apparatus for measuring the thickness between major surfaces of individual ones of a plurality of articles being conveyed along a path in a conveyance direction comprising the combination of measurement element means having a contact surface for sequentially contacting a major surface of individual articles being conveyed;

a reference element movable laterally relative to said conveyance direction into said plurality of articles for contacting and lifting an opposite major surface of individual ones of said articles;

means for synchronously driving said reference element as a function of speed of conveyance so that said measurement element means and said reference element contact opposite major surfaces of the same article during the same time;

said contact surface of said measurement element means having a neutral position and being deflectable away from said neutral position in accordance with the thickness of said article being contacted;

means for sensing the deflection of said contact surface; and means for evaluating said sensed deflection as a measure of thickness.

14. An apparatus according to claim 13 wherein said reference element is an impeller rotatable about a generally vertical axis and having a plurality of uniformly distributed vanes, each vane having a reference surface for contacting a major surface of an article being conveyed.

15. An apparatus according to claim 13 and including means for mounting said impeller laterally of said scale flow.

16. An apparatus according to claim 15 wherein said measurement element means comprises a sensing roll rotatably mounted on a shaft, a guide supporting said shaft, bearings supporting said guide for longitudinal movement, stop means for limiting movement of said guide in a direction toward said plurality of articles, and a spring urging said guide against said stop means, and wherein said means for sensing includes a displacement transducer having a measurement plunger attached to said guide.

17. An apparatus according to claim 16 wherein said stop means comprises a set screw adjustable toward and away from said plurality of articles.

18. An apparatus according to claim 13 wherein said measurement element means comprises a sensing roll rotatably mounted on a shaft, a guide supporting said shaft, bearings supporting said guide for longitudinal movement, stop means for limiting movement of said guide in a direction toward said plurality of articles, and a spring urging said guide against said stop means, and wherein said means for sensing includes a displacement transducer having a measurement plunger attached to said guide.

19. An apparatus according to claim 18 wherein said measurement element means includes a set screw forming a support for one end of said spring whereby the force of said spring is adjustable.

* * * * *